US005197599A

United States Patent [19]

Dolan

[11] Patent Number: 5,197,599

[45] **Date of Patent: * Mar. 30, 1993**

[54] SAMPLE PACKET ADAPTED FOR INSERTION INTO A NEWSPAPER

[75] Inventor: Colleen H. Dolan, Chicago, Ill.

[73] Assignee: Chicago Tribune Company, Chicago, Ill.

[ * ] Notice: The portion of the term of this patent subsequent to Apr. 21, 2009 has been disclaimed.

[21] Appl. No.: 779,379

[22] Filed: Oct. 18, 1991

Related U.S. Application Data

[63] Continuation-in-part of Ser. No. 504,965, Apr. 5, 1990, Pat. No. 5,105,941.

[51] Int. Cl.[5] ..... B65D 73/00

[52] U.S. Cl. ..... 206/232; 132/333; 283/56

[58] Field of Search ..... 206/205, 209, 216, 229, 206/361, 581, 823; 132/317, 319, 333; 434/377; 283/56

[56] References Cited

U.S. PATENT DOCUMENTS

| | | | |
|---|---|---|---|
| 885,778 | 4/1908 | Neuberger . | |
| 1,580,830 | 4/1926 | Lengel | 283/117 |
| 1,868,399 | 7/1932 | Slezak | 206/229 |
| 1,885,076 | 10/1932 | Bustamante | 206/229 |
| 2,069,332 | 2/1937 | Salfisberg . | |
| 2,185,386 | 1/1940 | Valentine | 206/823 |
| 2,561,400 | 7/1951 | Morrell | 206/229 |
| 2,833,402 | 5/1958 | Lefebvre . | |
| 3,809,483 | 5/1974 | Young | 206/229 |
| 4,492,306 | 1/1985 | Cooper et al. | 206/216 |
| 4,535,886 | 8/1985 | Salem | 206/205 |
| 4,637,712 | 1/1987 | Arnold et al. | 355/75 |
| 4,704,042 | 11/1987 | Eisen et al. | 402/79 |
| 4,747,782 | 5/1988 | Campbell, Jr. | 434/377 |
| 4,805,773 | 2/1989 | Sabongi | 206/823 |
| 4,824,143 | 4/1989 | Grainger | 132/317 |
| 4,848,378 | 7/1989 | Moir et al. | 132/319 |
| 4,876,136 | 10/1989 | Chang et al. | 206/823 |
| 4,890,872 | 1/1990 | Parrotta et al. | 206/823 |

*Primary Examiner*—Jimmy G. Foster
*Attorney, Agent, or Firm*—Arnold, White & Durkee

[57] ABSTRACT

A package for a product sample or the like that is suitable for insertion into newspaper publications with standard automatic insertion machinery. The package has a substantially smooth flat outer wrapper without unsecured edges that can tear during handling and/or jam the automatic insertion machinery. The package avoids the need to size and align the product sample for coincidence with an aperture in the outer wrapper. Finally, the package provides the maximum uninterrupted surface area for graphic and print advertising.

24 Claims, 3 Drawing Sheets

SAMPLE PACKET ADAPTED FOR INSERTION INTO A NEWSPAPER

This application is a continuation-in-part of U.S. patent application Ser. No. 504,965, filed Apr. 5, 1990, now U.S. Pat. No. 5,105,941.

FIELD OF THE INVENTION

The present invention relates to a package for a product sample or samples suitable for use as a newspaper insert, and particularly to a product sample package for use as a newspaper inset that is adapted to operate with automatic insertion machinery with a minimum amount of machinery jamming or package tearing or mutilation.

BACKGROUND OF THE INVENTION

It is often desirable to offer actual samples of a product, or various promotional articles, as part of advertisements incorporated into printed publications. In particular, it is desirable to provide a product package that can be inserted into newspapers with standard automatic insertion machinery. Since the product package or carriage is frequently inserted into an otherwise finished newspaper which must be distributed or delivered to the public within a relatively short period of time, it is particularly important to minimize the downtime of the insertion machinery due to jamming and to avoid tearing or mutilation of the package which can result in the entire newspaper being rejected in a quality control inspection. Of course, a newspaper containing a torn, crushed or otherwise mutilated product package can give the consumer the impression of poor quality which is to be avoided. It is also desirable that this package protect the product sample from being crushed when the newspapers are stacked on palettes. It is furthermore desirable that the packaging not create "footballing," or bulging, of the stacked newspapers. Such footballing causes the newspaper stack to be unstable and unduly concentrates the weight of the stacked papers on the inserted product samples.

Packages according to the prior art are generally in the form of relatively thin pouches that are sealed along their edges. In one example, a relatively thin sealed pouch has a strip along one side suitable for binding between pages of a printed magazine. Another example has a sheet member that wraps around a plurality of product sample packages to protect the product samples. The sheet member also has a strip along one side suitable for binding between pages of a printed magazine. Still another example has a pouch that contains a rigid member to prevent the pouch contents from being excessively compressed by the stacking process.

Although the three examples described above may be suitable for binding in a printed magazine, they are not suitable for inserts for newspaper publications. This is because the automatic insertion machinery requires that the insert be substantially planar over its major surfaces, that it have a relatively blunt and rigid leading edge for insertion into the feed rolls for the insertion machine, and that it have flexibility to bend around the surface of the feed rolls until fed into the feed bin of the insertion machinery.

None of the examples described above have leading edges suitable for automatic insertion purposes. Furthermore, the first two examples have no protection against crushing of the product samples that they contain. Furthermore, the third example containing the rigid member can interfere with the degree of flatness and flexibility required to properly pass through the feed rolls of the automatic insertion machinery.

The product package or carriage disclosed in U.S. patent application Ser. No. 504,965 overcomes the disadvantages of known sample package inserts. It is relatively flat over its major surfaces and has a relatively blunt rigid leading edge for insertion into the feed rolls of automatic insertion machinery. In addition, it has sufficient flexibility to follow the curvature of the surface of the feed rolls of the automatic insertion machinery. Finally, since the product sample is nested within an aperture of a substrate of substantially the same thickness as the product sample, the overall package has a substantially uniform thickness thereby preventing a stack of newspapers containing the packages from "footballing" while also protecting the sample from being crushed due to the weight of the stacked newspapers. However, at least one embodiment of this package has an aperture or opening in the upper surface of the outer wrapper which must be both sized and aligned with the sample insert for the purpose of making the sample visible through the package. This aperture or opening results in several practical disadvantages.

First, in assembling the package the outer wrapper must be registered or aligned so that the aperture or opening corresponds to the position of the sample. If there is any misalignment between the product sample and the aperture or opening a portion of the sample is obscured from view and the overall appearance of the package is ruined. In addition, the aperture or opening must be signed to correspond to the product sample. If the aperture is made larger than the product sample for any reasons, such as to provide some tolerance to accommodate for misalignment, then an unsightly border area around the sample becomes visible through the aperture. Of course, if the aperture is made smaller than the product sample, a portion of the sample is obscured from view. Thus, in order to achieve an attractive package a close tolerance between the aperture size and the sample size must be maintained. In addition, the sample must be precisely aligned or registered with the aperture or opening to assure the proper unobstructed presentation of the sample through the aperture. This maintenance of tolerances and alignment requirements increases the manufacturing set up time and increases the volume of unsatisfactory or rejected packages.

Second, the outer wrapper surface has several free or unsecured edges surrounding the aperture. When the package is moving into and through the automatic insertion machinery, these unsecured edges can become caught or entangled causing the outer wrapper of the package to tear or wrinkle or to otherwise become mutilated. This disadvantage not only increases the volume of rejected or waste packages, but can also result in the automatic insertion machinery becoming jammed, shutting down the automatic insertion line. Since this insertion process can be one of the final steps in assembling the newspapers for distribution or delivery, any downtime for the automatic insertion machinery can jeopardize the timely distribution or delivery of the newspaper. Of course, these unsecured edges of the aperture in the outer wrapper can become snagged or torn during other processing or handling operations.

Third, the use of the aperture or opening to display the sample can interfere with the placement or layout of print or graphic advertising material on the surface of the package. The advertising layout person must arrange the graphic and text advertising material around the aperture. This task can often be difficult and can restrict or interrupt the communication of the overall advertising message desired by the sample manufacturer.

OBJECTS OF THE INVENTION

Therefore, it is a primary object of the present invention to provide a product sample package for product samples and the like that is suitable for use as an insert for a newspaper publication.

It is another object of the invention to provide a package for product samples that is suitable for automatic insertion machinery used for newspaper publications.

It is yet another object of the invention to provide a product sample package that does not have any aperture or opening on the outer surface that requires size tolerances to match the size of the sample.

It is still another object of the invention to provide a product sample package that does not have any aperture or opening on the outer surface that requires alignment or registration with the product sample within the package.

It is a further object of the invention to provide a product sample package that does not have any unsecured or loose edges on the surface that can be torn during handling or processing which can result in a ruined package or jamming of the automatic insertion machinery.

It is a still further object of the invention to provide a product sample package that provides the maximum uninterrupted surface area for the printing or display of advertising.

Other objects and advantages of the present invention are realized as described below in connection with the detailed description of the preferred embodiment of the invention and recited in the appended claims.

SUMMARY OF THE INVENTION

The present invention achieves the abovedescribed objects, as well as other objects and advantages, with a product sample package that contains a unilaterally flexible, substantially flat substrate having at least one aperture therethrough large enough to surround the product sample, or at least a substantial portion thereof. The package also has an at least partially opaque outer sheath or wrapper without any apertures or openings therein to avoid tearing during handling or processing with the automatic insertion machinery.

The product sample is adhered to the inner surface of the outer sheath or wrapper and the substrate is adhered to the inner surface of the outer sheath so that its aperture surrounds the product sample, or at least a portion thereof. The outer sheath is folded over the substrate with the product sample therein to completely envelope or cloak the product sample and substrate. The open ends of the outer sheath are then sealed together.

The substrate has sufficient thickness to protect the product sample against crushing, as well as sufficient area to prevent footballing from occurring when the package is inserted into a newspaper. The edge of the outer sheath folded over the edge of the substrate provides a blunt, relatively rigid edge suitable for insertion into the feed rolls of automatic insertion machinery. The substrate also has sufficient flexibility to allow the package to conform to the curvature of the feed rolls.

DETAILED DESCRIPTION OF THE PREFERRED EMBODIMENT

Figure 1:
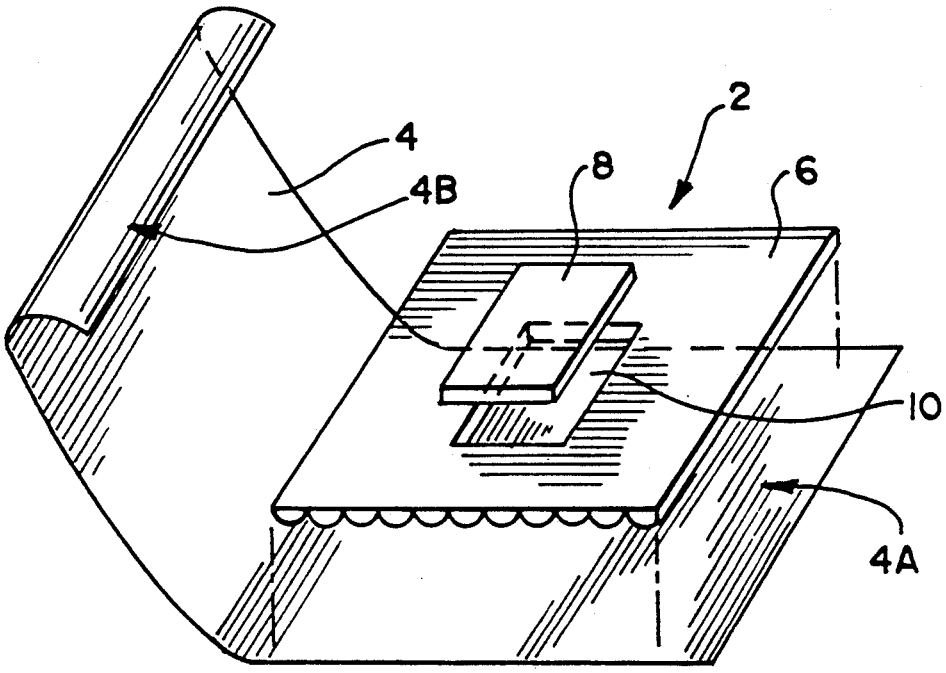
FIG. 1 is an exploded view of the preferred embodiment of the present invention.

Referring to the drawings, wherein reference characters represent like or corresponding parts throughout the views, FIG. 1 shows an exploded view of the preferred embodiment of the invention. The preferred embodiment comprises a sample product packet assembly 2 having an at least partially opaque outer sheath 4 that envelopes a flexible substrate 6 and a product sample 8 nestled within an aperture 10 in the substrate 6.

The product sample 8 and the substrate 6 that surrounds it are aligned and fastened to the inner surface 4*a* of the outer sheath 4. The product sample 8 and the substrate 6 are both fastened to the outer sheath with any convenient sealing means, such as with a thermobond or adhesive. The product sample 8 is most conveniently spot glued with an adhesive to aid later removal from the packet 2. As an alternative, the product sample 8 may be fastened to a separate card or sheet of material (not shown). The sheet of material with the product sample fastened thereto is then glued to the inner surface 4*a* of the outer sheath 4. The substrate 6 is then positioned to surround the product sample 8 and fastened to the sheet of material. This alternative permits the product sample 8 to be glued or fastened to the separate sheet of material during a different operation for convenience in overall assembly.

The outer sheath 4 is wrapped around the substrate 6 and the product sample 8 to completely envelope or clock them as shown in FIG. 1. In the preferred embodiment the outer sheath 4 is completely opaque, however, in an alternative embodiment a portion of the outer sheath could be transparent (e.g., demetalized foil) but the product sample is not aligned with respect to any transparent portion of the outer wrapper and, accordingly, is not visible. The outer sheath 4 has only a single fold along one edge of the substrate 6. The outer sheath 4 may comprise any heavy duty wrapping material, such as thermoplastic film or heavy weight paper. Seventy pound kraft paper is preferred for this purpose. The outer surface 4*b* of the outer sheath 4 is smooth and free from unsecured edges. This avoids having the edges torn during handling or in the automatic insertion machinery. In addition, it eliminates the package from catching an edge during processing by the automatic insertion machinery and jamming or otherwise disabling the operation of the machinery. Furthermore, the outer surface 4*b* provides an uninterrupted surface for the printed or graphic advertising message.

The substrate 6 may comprise any heavy duty, lightweight sheet material that has relative rigidity along its length parallel to the folds in the outer sheath 4 and flexibility along its width transverse to the folds in the outer sheath 4. To this end, the substrate 6 may comprise a splined or fluted material or lamination that has its splines or flutes arranged substantially parallel to the direction of the folds in the outer sheath 4. Alternatively, the substrate 6 may comprise a thermoplastic foam material.

The substrate 6 preferably has a thickness roughly approximating the thickness of the product sample 8. The sheet material comprising the substrate 6 may be folded over a number of times on itself to form a laminate having sufficient thickness to approximate the thickness of the product sample 8.

Single-faced, corrugated cardboard with type "A" fluting is preferred sheeting material for the substrate 6. The flutes should be substantially parallel, to opposite sides of the substrate 6. The direction of the flutes is arranged to be parallel to the direction of the fold in the outer sheath 4.

The fluted side of the single-faced corrugated cardboard should be fastened to the inner surface of the outer sheath 4. The corrugated cardboard may be folded over upon itself any number of times to build up to a thickness approximating the thickness of the product sample 8.

The aperture 10 is cut through the substrate 6. It has dimensions that allow the product sample 8 to be placed within it. In the preferred embodiment, the aperture 10 has dimensions somewhat larger than those of the product sample 8 to allow automatic dispensing machinery to place the product sample 8 within the aperture 10.

Alternatively, the aperture 10 may be sized so that it slightly overlaps the products sample 8 along one edge of the product sample 8. In this case, the product sample 8 may be attached to the substrate 6 instead of the outer sheath 4 with suitable sealing means, such as with a thermobond or adhesive.

Of course, although only one of the apertures 10 with a single associated product sample 8 is shown in FIG. 1, any number of the apertures 10 can be cut into the substrate 6 to accept a plurality of the product samples 8. In this case, the apertures 10 may be of different sizes and shapes to accommodate different sizes and shapes of the product samples 8.

Figure 2:
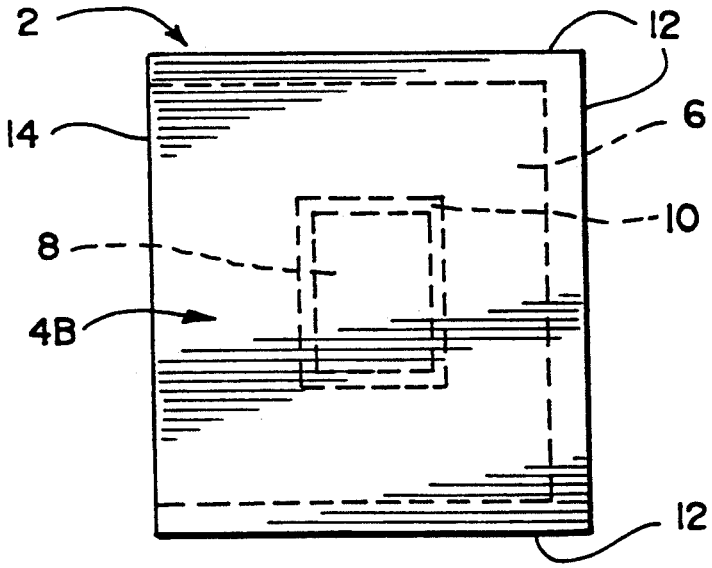
FIG. 2 is a front view of the preferred embodiment of the present invention.

The folded outer sheath 4 forms three edges 12. The edges 12 are sealed with any convenient sealing means, such as with a thermobond or adhesive material, to completely seal the product sample and substrate within the packet 2. A front side view of the assembled packet 2 is shown in FIG. 2.

The packet 2 has only a single blunt rigid edge 14, corresponding to the single fold in the outer sheath 4, that is suitable for inserting into the feed rolls of automatic insertion machinery. The choice of embodiments, or variations thereof, depends on associated packet assembly requirements and machinery.

Figure 3:
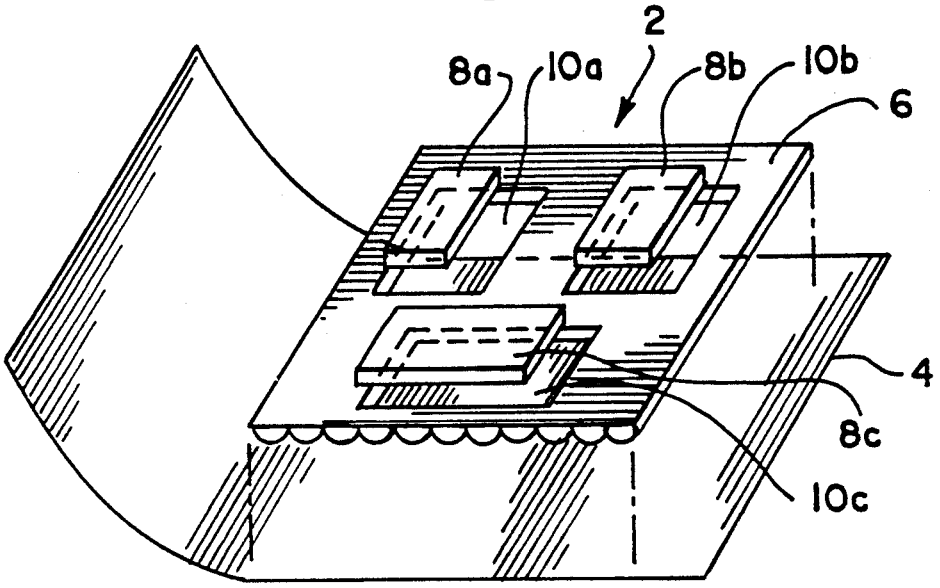
FIG. 3 is an exploded view of the preferred embodiment of the invention with a plurality of product samples.

FIG. 3 shows an exploded view of the packet 2 with three of the product samples 8, represented as the product samples 8*a*, 8*b* and 8*c*. Each of the product samples 8*a*, 8*b* and 8*c* have corresponding apertures 10*a*, 10*b* and 10*c*.

The thickness of the substrate 6 should be thick enough to roughly approximate the thickness of the thickest one of the product samples 8. The apertures 10 should also be spaced from the edges of the substrate 6 parallel to the folds in the outer sheath 4 with a spacing wide enough to insure that the counting mechanism for the automatic insertion machinery functions properly.

Generally, accurate counting requires that the thickness of the product packet 2 along the edge inserted into the automatic insertion machinery have a uniform thickness along its length inward for at least an inch and a half. Therefore, a margin of approximately an inch and a half along these edges of the substrate 6 is recommended.

Figure 4:
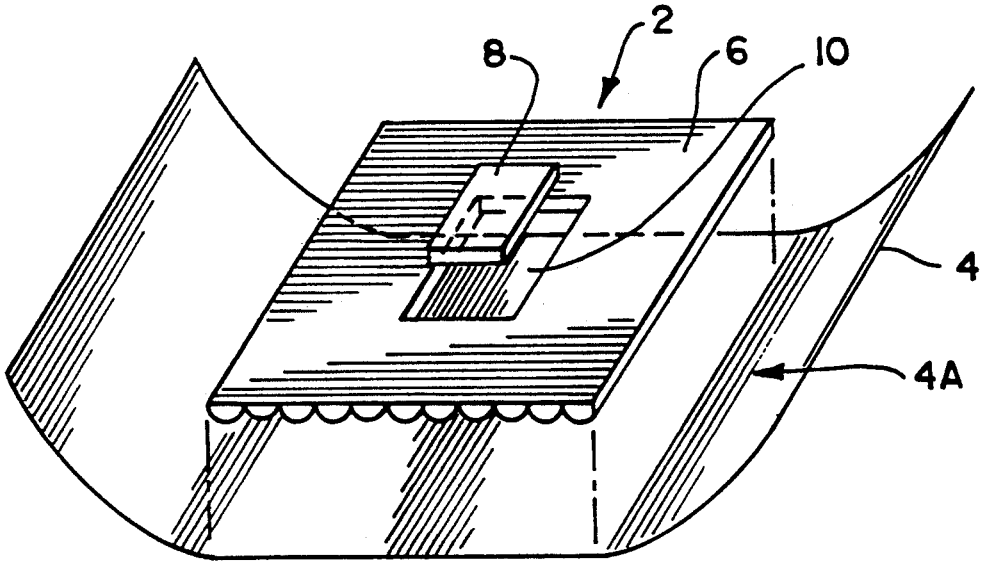
FIG. 4 is an exploded view of an alternative embodiment of the present invention.

FIG. 4 shows an exploded view of an alternative embodiment of the invention. The alternative embodiment comprises a sample packet assembly 2 having an outer sheath or wrapper 4 that envelopes a flexible substrate 6 and a product sample 8 nestled within an aperture 10 in the substrate 6. The product sample 8 and the substrate 6 that surrounds it are fastened to the inner surface 4*a* of the outer sheath in the same manner as described with regard to the preferred embodiment. In addition, the material forming the outer sheath 4 and the substrate 6 is the same as the material described with regard to the preferred embodiment.

Figure 5:
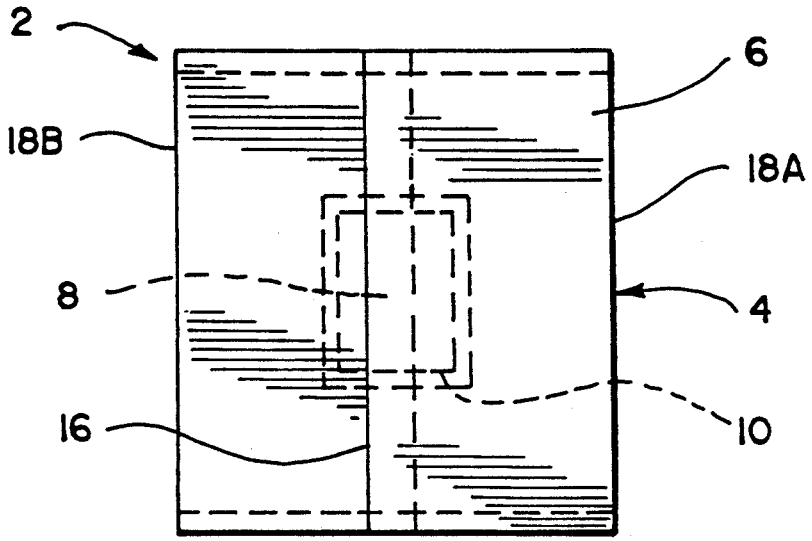
FIG. 5 is a rear view of the alternative embodiment of the present invention.

After the substrate 6 and product sample 8 are fastened to the inner surface of the outer sheath 4, the ends of the outer sheath 4 are wrapped around the substrate 6 and product sample 8 to completely envelope them as shown in FIG. 5. The folded ends overlap each other to form a seam 16 along the back surface of the substrate 6.

The seam 16 is sealed with a convenient sealing means, such as a thermobond or adhesive. The edges of the outer sheath 4 transverse to the seam 16 are then sealed with a convenient sealing means, such as a thermobond or adhesive, to completely seal the substrate 6 and the product sample 8 within the outer sheath 4.

Figure 6:
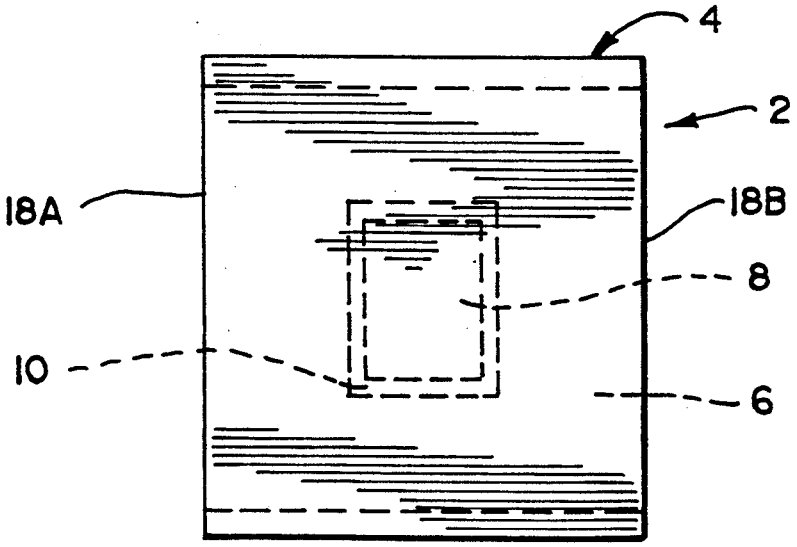
FIG. 6 is a front view of the alternative embodiment of the present invention.

FIG. 6 shows the front side of the assembled packet 2. The packet 2 has blunt, rigid edges 18 on two sides, corresponding to the folds in the outer sheath, suitable for insertion into the feed rolls of automatic insertion machinery.

The alternative embodiment shown in FIGS. 4–6 has only a single edge or seam 16. In order to reduce the possibility of seam 16 getting caught in the automatic insertion machinery the overlapping portion of the outer sheath 4 forming the seam 16 is glued as close as possible to the edge. In addition, the outer sheath 4 wraps around both edges of the substrate 6 forming blunt edges 18*a* and 18*b*, refer to FIGS. 5 and 6. While both edges 18*a* and 18*b* are suitable for use as the leading edge for insertion into the automatic machinery, edge 18*a* is preferably used as the leading edge. Therefore, as the packet 2 moves through the automatic insertion machinery the edge of seam 16 tends to lay flat and avoids tearing.

Thus, there as been described above packages for product samples and the like that are suitable for insertion into newspaper publications with standard automatic insertion machinery. These packages have a smooth outer surface free of unsecured edges that can tear during handling or processing in the automatic insertion machinery resulting in an unsightly package or jamming of the machinery. The packages do not have any apertures in the outer sheath or wrapper and thus avoid the need for sizing the aperture and aligning the aperture with the product sample within the package. The packages also provide the maximum amount of uninterrupted surface area for graphic or print advertising. It will be understood that various changes in the details, arrangement of parts, and assembly procedures from those described above to explain the nature of the present invention may be made by those skilled in the art within the principle and scope of the present invention as expressed in the appended claims.

What is claimed is:

1. A package for a product sample suitable for insertion between pages of a printed publication, comprising:

a flexible, substantially planar substrate having a thickness approximating the thickness of a product sample and at least one aperture in said substrate nestling said product sample therein;

an at least partially opaque outer sheath, wrapped around at least one edge of said substrate, for completely enveloping said substrate and product sample and cloaking said product sample; and said substrate comprising a fluted material having flutes substantially parallel to opposite edges of said substrate.

2. A package recited in claim 1 wherein said package has a substantially uniform thickness.

3. A package recited in claim 1 wherein said outer sheath is in contact with said edge.

4. A package recited in claim 1 wherein said outer sheath is wrapped around opposite edges of said substrate.

5. A package recited in claim 4 wherein said outer sheath is in contact with both of said edges.

6. A package recited in claim 1 wherein said substrate further comprises folds of said fluted material upon itself to form a laminate of said fluted material.

7. A package recited in claim 1 wherein said substrate comprises a fluted thermoplastic sheet.

8. A package recited in claim 7, wherein said corrugated cardboard is single sided, with type "A" flutes.

9. A package recited in claim 1 wherein said substrate comprises corrugated cardboard.

10. A package recited in claim 1 wherein said outer sheath comprises a thermoplastic sheet.

11. A package recited in claim 1 wherein said outer sheath comprises wrapping paper.

12. A package recited in claim 11, wherein said wrapping paper comprises seventy pound weight kraft paper.

13. A package for a product sample suitable for insertion between pages of a printed publication, comprising:

a flexible, substantially planar substrate having a thickness approximating the thickness of a product sample and at least one aperture in said substrate nestling said product sample therein;

an at least partially opaque outer sheath, wrapped around at least one edge of said substrate, for completely enveloping said substrate and product sample and cloaking said product sample; and said substrate comprising a fluted material having flutes substantially parallel to the direction of the fold of said outer sheath.

14. The package recited in claim 13 wherein said substrate further comprises folds of said fluted material upon itself to form a laminate of said fluted material.

15. The package recited in claim 13, wherein said substrate comprises a fluted thermoplastic sheet.

16. The package recited in claim 13, wherein said substrate comprises corrugated cardboard.

17. The package recited in claim 16, wherein said corrugated cardboard is single sided, with type "A" flutes.

18. The package recited in claim 13, wherein said outer sheath comprises a thermoplastic sheet.

19. The package recited in claim 13, wherein said outer sheath comprises wrapping paper.

20. The package recited in claim 19, wherein said wrapping paper comprises seventy pound weight kraft paper.

21. A package recited in claim 13 wherein said package has a substantially uniform thickness.

22. A package recited in claim 13 wherein said outer sheath is in contact with said edge.

23. A package recited in claim 13 wherein said outer sheath is wrapped around opposite edges of said substrate.

24. A package recited in claim 23 wherein said outer sheath is in contact with both of said edges.

* * * * *